United States Patent [19]

Holzapfel

[11] 4,356,830

[45] Nov. 2, 1982

[54] CLEANSING APPARATUS FOR TEST-VESSELS

[75] Inventor: Christian Holzapfel, Julich, Fed. Rep. of Germany

[73] Assignee: Kernforschungsanlage Julich GmbH, Julich, Fed. Rep. of Germany

[21] Appl. No.: 214,974

[22] Filed: Dec. 10, 1980

[30] Foreign Application Priority Data

Dec. 13, 1979 [DE] Fed. Rep. of Germany ..... 2950074

[51] Int. Cl.[3] ..... B08B 3/02; B08B 9/08

[52] U.S. Cl. ..... 134/152; 134/86; 134/136; 134/166 R; 134/196

[58] Field of Search ..... 134/44, 47, 86, 135–136, 134/145, 152, 163, 166 R, 169 R, 170, 196

[56] References Cited

U.S. PATENT DOCUMENTS 2,141,516 12/1938 Clements ..... 134/170 X
2,475,407 7/1949 Sell ..... 134/166 R X
3,139,097 6/1964 Hungerford et al. ..... 134/145
3,384,100 5/1968 Ross et al. ..... 134/166 R

FOREIGN PATENT DOCUMENTS 7951 11/1879 Fed. Rep. of Germany ..... 134/152

*Primary Examiner*—Robert L. Bleutge
*Attorney, Agent, or Firm*—Shlesinger, Arkwright, Garvey & Dinsmore

[57] ABSTRACT

A cleansing apparatus for test-vessels such as cuvettes or the like comprising a support shaft and three spaced paralleled disks, two of said disks being secured to the shaft and the third disk being rotatably positioned on the shaft, a nozzle secured to the first disk, the second and third disks having apertures thereon for receiving cuvettes, so that a cuvette may be positioned over the nozzle through the apertures in one of the disks, and retained by the rotatable disk so that immersion of the apparatus into a cleansing solution forces a jet of solution through the nozzle for cleansing the cuvette.

10 Claims, 2 Drawing Figures

CLEANSING APPARATUS FOR TEST-VESSELS

The invention relates to a test-vessel or cuvette cleansing apparatus with a holding means for receiving the test-vessels with their mouths opening downwardly, and with entry spray orifices for the cleansing liquid pointing into the cuvettes, possibly also having cleansing liquid container receiving the holding means.

BACKGROUND OF THE INVENTION

Quartz and glass test-vessels are frequently used in optical measurements. Such test-vessels are commonly known as "cuvettes" and typically have a square or rectangular cross-section with straight sides. The shapes of such cuvettes thereby means that there are corners formed by the side walls and the bottom of the vessel. When rinsing such cuvettes following use, there is frequently the problem of fully rinsing the residual substance out of the corners of the cuvette, and that mere softening-up and rinsing underneath the water tap will not always be adequate, in particular as regards cuvettes having small openings, because the pressure of the jet is inadequate to reach all corners of the cuvette.

Apparatus for rinsing test-vessels already is known, and comprises in addition to a test-vessel holding means, an entry orifice and a magnetic stirrer to agitate the cleansing liquid. However this known apparatus also fails to provide for adequate rinsing by the cleansing liquid in all corners.

Accordingly there is no simple apparatus for rinsing test-vessels that operates reliably and efficiently, and this problem is overcome by the invention.

The present invention is characterized by three congruent plates or disks perpendicularly mounted to a bar, each disk comprising one borehole for each cuvette, the spacing between the lowermost and the center disk and that between the lowermost disk and the uppermost disk respectively being slightly less, and slightly larger than the length of the test-vessel, and with the lowermost and center disks being fixed while the uppermost disk is radially rotatable about the bar. The test-vessels are inserted through the boreholes of the center and upper disks, and nozzles, acting as entry orifices, are present in the boreholes of the lowermost disk.

Further objects, advantages and characteristics of the invention will be discussed in the description below and the appended claims.

The invention is discussed in further detail below in relation to the drawing and a preferred embodiment.

Figure 1:
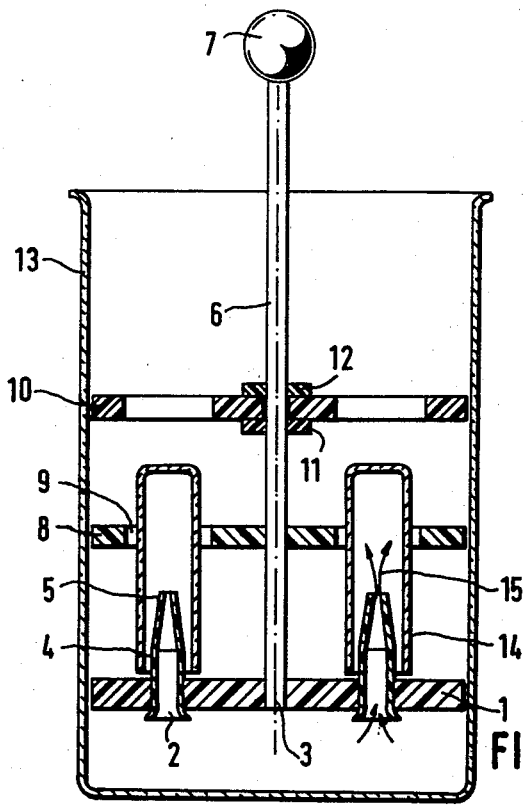
FIG. 1 is a longitudinal cross sectional view of the apparatus.
Figure 2:
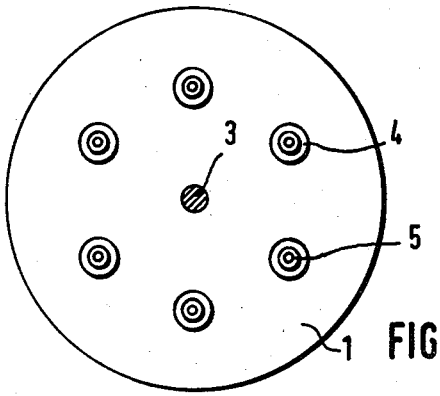
FIG. 2 is a top plan view thereof.

Several boreholes, six in the embodiment shown, are provided in a circular plastic plate 1 and are arranged equally spaced around the central axis 3 of a bar 6, illustrated as holes 2. Conical nozzles 4 pass through each of these holes 2 in such a manner that the narrow aperture 5 points upwardly. The disk 1 is mounted centrally on the bar 6. This bar 6 is provided with a handle 7 at the top.

A central disk 8 also is centrally mounted on the bar 6 and at a spacing which is less than the length of one cuvette 14. This disk 8 is provided with boreholes 9 which correspond in numbers and radial array to the arrangement of the holes (therefore, in the embodiment shown there are six boreholes). The dimensions of the boreholes 9 are greater than the corresponding dimensions of the cuvettes 14. An upper disk 10 also is mounted centrally on the bar 6 at a slightly larger spacing than the length of the cuvettes however, contrary to what is the case for disks 1 and 8, it is rotatable about the axis of bar 6, for instance between two fixed flanges 11 and 12. The diameters of the disks are so selected that the apparatus fits into a suitable beaker 13 acting as the container, preferable a 1,000 ml glass beaker with a diameter of about 100 mm.

The disks 1 and 8 may be mounted on the bar 6 so as to be adjustable vertically therein, such as by friction fit, in order to accommodate cuvettes of different size.

The cuvettes 14 to be cleaned are inserted through the boreholes in the disks 10 and 8 and are placed upside down on the nozzles 4 in such a manner that the nozzle apertures 5 point toward the inside of the test-vessels. As the boreholes 9 of disk 8 are always coaxial with the holes 2 of disk 1, the upper disk can be rotated about its axis, whereby the test-vessels 14—once they have been placed on the nozzles 4—are held sideways by the rims of the boreholes 9 and from above by the disk 10 once latter has been slightly rotated. If then this assembly is immersed in the beaker 13 which has been half-filled with the cleansing liquid, and if this assembly is forced downward through this liquid, then this liquid will be sprayed through the nozzle apertures 5 into the test-vessels 14 (as indicated by the arrows 15).

By repeatedly moving the assembly up and down in the cleansing liquid, the corners of the test-vessels 14 will also be rinsed by the nozzle jets.

The nozzles 4 may be plastic single-use pipet tips such as are used in any chemical laboratory.

Accordingly the invention offers an economical and easily made apparatus by means of which a given number of test-vessels (six in this instance) can be thoroughly cleansed simultaneously and at low cost.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

I claim:

1. A cleansing apparatus for cuvettes comprising:

a support shaft, first and second parallel disks secured perpendicularly to said shaft and spaced apart along said shaft a distance slightly less than the length of a cuvette to be cleansed, nozzle means mounted on and extending through said first disk and directed toward said second disk, said second disk having first aperture means therein aligned with said nozzle means so that a cuvette may be inserted through said first aperture means and over said nozzle means and the cuvette is retained against lateral displacement by said second disk, a third disk rotatably mounted on said shaft and having second aperture means therein capable of being aligned or misaligned with respect to said first aperture means by rotation of said third disk on said shaft, whereby a cuvette may be inserted through aligned first and second aperture means and over said nozzle means and retained by slight rotation of said third disk so that said first and second aperture means are misaligned and whereby immersion of said apparatus into a cleansing solution forces a jet of solution through said nozzle means for cleansing the cuvette.

2. A cleansing apparatus as in claim 1 and wherein said disks are circular.

3. A cleansing apparatus as in claim 2 and wherein said disks are coaxially mounted on said shaft.

4. A cleansing apparatus as in claim 3 and wherein said disks are plastic.

5. A cleansing apparatus as in claim 4 and wherein said first and second aperture means each comprise six equally spaced apertures and said nozzle means comprises six equally spaced nozzle members.

6. A cleansing apparatus as in claim 5 and wherein said nozzle members each are conical and pointed toward said second disk.

7. A cleansing apparatus as in claim 6 and wherein said shaft includes a handle at the end remote from said first disk.

8. A cleansing apparatus as in claim 7 and wherein said shaft includes two spaced flanges secured thereon and said third disk is rotatable between said flanges.

9. A cleansing apparatus as in claim 8 and wherein said disks are axially adjustable along said shaft.

10. A cleansing apparatus as in claim 1 or 8 and including a receptacle for containing a cleansing solution and having an inside dimension slightly greater than the outer dimensions of said disks.

* * * * *